US010220225B2

(12) United States Patent
Gamba

(10) Patent No.: US 10,220,225 B2
(45) Date of Patent: Mar. 5, 2019

(54) SLIDING ROPE SAFETY DEVICE FOR ROOFS AND THE LIKE, CORRESPONDING METHOD FOR DAMPING THE STRESSES ACTING ON A USER OF A ROPE SAFETY DEVICE AND GUARD RAIL WITH A SLIDING ROPE

(71) Applicant: Davide Gamba, Biella (IT)

(72) Inventor: Davide Gamba, Biella (IT)

( * ) Notice: Subject to any disclaimer, the term of this patent is extended or adjusted under 35 U.S.C. 154(b) by 0 days.

(21) Appl. No.: 15/328,454

(22) PCT Filed: Jun. 8, 2015

(86) PCT No.: PCT/IT2015/000150
§ 371 (c)(1),
(2) Date: Jan. 23, 2017

(87) PCT Pub. No.: WO2015/189867
PCT Pub. Date: Dec. 17, 2015

(65) Prior Publication Data

US 2017/0209721 A1 Jul. 27, 2017

(30) Foreign Application Priority Data

Jun. 10, 2014 (IT) ..... BI2014A0005

(51) Int. Cl.
*A62B 35/04* (2006.01)
*A62B 35/00* (2006.01)
(Continued)

(52) U.S. Cl.
CPC ..... *A62B 35/04* (2013.01); *A62B 35/0068* (2013.01); *E01F 15/025* (2013.01);
(Continued)

(58) Field of Classification Search
CPC ..... A62B 35/00; A62B 35/04; A62B 35/0068; E04G 21/32; E04G 21/328; E04G 21/329; E01F 15/025; E01F 15/06
See application file for complete search history.

(56) References Cited

U.S. PATENT DOCUMENTS 532,242 A 1/1895 McShane
2,151,664 A * 3/1939 Redfield ..... D06F 53/00 24/129 R
(Continued)

FOREIGN PATENT DOCUMENTS

CH 693639 A5 11/2003
DE 3345290 A1 6/1985
(Continued)

OTHER PUBLICATIONS

International Preliminary Report on Patentability (inclusive of annexes) for PCT/IT2012/000306 filed on Oct. 6, 2012 in the name of Gamba, Davide, dated Jan. 17, 2014, 30 pages.
(Continued)

*Primary Examiner* — Katherine W Mitchell
*Assistant Examiner* — Shiref M Mekhaeil
(74) *Attorney, Agent, or Firm* — Steinfl + Bruno, LLP

(57) ABSTRACT

A rope safety device (10,10-1) installed as a sub-roof element on a roof (T), a covering or a similar structure, comprising: a fixing and damping plate (11), perforated, fixed to the roof structure (T): and a rope (12) associated with the fixing and damping plate, wherein the rope (12) has an attachment portion (12*a*), in the form of an eyelet (12'), via which an operator can attach to the rope (12), so as to operate in a safe condition on the roof on which the device is installed: wherein the plate (11) has a configuration with one or more holes (13, 13*b*) used to insert the rope (12) and
(Continued)

wherein the rope (12) is configured and set with respect to the plate, in whose holes (13*b*) is inserted, in such a way that the rope (12), when it is subject by the operator, attached to the same rope, to a given traction force (FT), slides (f) along a certain stroke (D) in the holes (13*b*) of the fixing and damping plate (11) before being retained by the latter. in a further embodiment (10-2), suitable for application in combination with a rope safety line (LS) or life line system, the safety device to the rope (10) can comprise, as an alternative to the plate perforated, a calibrated damp (16), associated with the rope (12) and defining an eyelet (12*e*) for coupling the device (10, 10-2) to the rope (F) the safety-line, in which the terminal (16) the cable (12) flows (f') in a controlled way when it is subject, on the part of an operator attached to the same rope (12), to a traction force (FT). Advantageously the device rope safety slide (10, 10-1, 10, 10-2) of the invention, installed on a roof (T) or similar structure, is adapted to dampen and absorb effectively the impact and the stress suffered by an operator, when, being attached to the rope (12) of the device (10) to operate in conditions of safety on the roof (T), accidentally puts into traction and pulls the cable (12) The invention also concerns an innovative guardrail (20) having a metal structure (21) substantially identical to that of a conventional guard rail, and a rope device (22) which is associated with a containment rail (21*b*) of the metal structure (21) of the guard rail (20) and whose rope (12) is subject to a controlled sliding or slipping when a vehicle skids and hits the guard rail (20), so as to efficaciously absorb and dissipate the impact energy caused by such a collision.

3 Claims, 12 Drawing Sheets

(51) Int. Cl.
*E01F 15/02* (2006.01)
*E01F 15/06* (2006.01)
*E04G 21/32* (2006.01)

(52) U.S. Cl.
CPC ..... *E01F 15/06* (2013.01); *E04G 21/328* (2013.01); *E04G 21/329* (2013.01)

(56) References Cited

U.S. PATENT DOCUMENTS 2,466,083 A * 4/1949 Crosby ..... H02G 7/056 24/129 B
3,235,031 A * 2/1966 Cenker ..... A62B 1/06 182/5
3,757,901 A * 9/1973 Hobbs ..... A62B 1/14 182/5
3,813,733 A 6/1974 Flohr
3,930,288 A * 1/1976 Black ..... B66C 1/12 24/129 R
3,997,945 A * 12/1976 Robins ..... E06B 11/04 135/119
4,034,443 A * 7/1977 Turner ..... F16G 11/14 24/129 B
4,317,257 A 3/1982 Engel
4,529,240 A 7/1985 Engel
4,549,332 A 10/1985 Pouliot
4,640,179 A 2/1987 Cameron
4,678,059 A * 7/1987 Bowker ..... A62B 1/04 182/5
5,137,112 A 8/1992 Nichols
5,269,128 A 12/1993 Walton et al.
5,295,559 A * 3/1994 Nutkins ..... A62B 1/04 182/191
5,379,858 A * 1/1995 Sandoval ..... A62B 1/14 182/193
8,050,007 B1 * 11/2011 DeGurski ..... H02G 13/00 361/117
8,439,976 B2 * 5/2013 Albertorio ..... A61B 17/0401 623/13.14
8,925,680 B2 * 1/2015 Herrli ..... A62B 1/14 182/192
9,175,437 B2 11/2015 Gamba
2002/0079164 A1 6/2002 Choate
2005/0241348 A1 * 11/2005 Devecki ..... B63C 11/02 70/18
2006/0059844 A1 * 3/2006 Ely ..... E04G 21/3261 52/698
2007/0261921 A1 * 11/2007 Gal ..... A62B 1/08 182/233
2008/0000719 A1 * 1/2008 Jones ..... A62B 35/0075 182/3
2008/0184534 A1 8/2008 Lara
2010/0101833 A1 4/2010 Zachariades et al.
2010/0187040 A1 7/2010 Siemienowicz
2011/0189411 A1 8/2011 Elad et al.
2012/0067667 A1 * 3/2012 Marcoux ..... A62B 35/0068 182/3
2012/0251245 A1 * 10/2012 Spearing ..... E21D 21/008 405/302.2
2015/0026930 A1 1/2015 Schmitz
2015/0050515 A1 2/2015 Gamba
2015/0176678 A1 * 6/2015 Burrell ..... F16G 11/046 24/129 R

FOREIGN PATENT DOCUMENTS

DE 20202989 U1 6/2002
DE 202004012456 U1 12/2004
DE 202005011463 U1 9/2005
EP 0435441 A2 11/1990
EP 1748104 A1 1/2007
EP 2317029 A2 5/2011
EP 1891364 B1 5/2013
FR 2851924 A1 9/2004
FR 2950408 A1 3/2011
NL 1035225 C2 10/2009
WO 2005/028757 A1 3/2005
WO 2007/134746 A1 11/2007
WO 2013/051043 A2 4/2013
WO 2015/189867 A1 12/2015

OTHER PUBLICATIONS

International Preliminary Report on Patentability (inclusive of annexes) for International Application No. PCT/IT2016/000254 filed Oct. 25, 2016 on behalf of Davide Gamba, dated Jan. 23, 2018. 32 pages.
International Search Report for International Application No. PCT/IT2012/000306 filed Oct. 3, 2012 on behalf of Davide Gamba, dated Aug. 6, 2013. 8 pages.
International Search Report for International Application No. PCT/IT2016/000254 filed Oct. 25, 2016 on behalf of Davide Gamba, dated Mar. 16, 2017. 4 pages.
Molkow, W. et al., "Educational Focus: Elevator Suspension Systems Wire Rope for Elevator Suspension," *Elevator World*51 (5), 100-117, (May 2003). 11 pages.
Non-Final Office Action for U.S. Appl. No. 14/348,856, filed Mar. 31, 2014 on behalf of Davide Gamba, dated Feb. 18, 2015. 8 pages.
Final Office Action for U.S. Appl. No. 14/348,856, filed Mar. 31, 2014 on behalf of Davide Gamba, dated Jun. 5, 2015. 5 pages.
Notice of Allowance for U.S. Appl. No. 14/348,856, filed Mar. 31, 2014 on behalf of Davide Gamba, dated Aug. 21, 2015. 5 pages.
Written Opinion for International Application No. PCT/IT2012/000306 filed Oct. 3, 2012 on behalf of Davide Gamba, dated Aug. 6, 2013. 13 pages.
Written Opinion for International Application No. PCT/IT2016/000254 filed Oct. 25, 2016 on behalf of Davide Gamba, dated Mar. 16, 2017. 8 pages.

(56) References Cited

OTHER PUBLICATIONS

International Search Report and Written Opinion for International Application No. PCT/IT2015/000150 filed Jun. 8, 2015 on behalf of Davide Gamba, dated Nov. 27, 2015. 17 pages.
International Preliminary Report on Patentability for International Application No. PCT/IT2015/000150 filed Jun. 8, 2015 on behalf of Davide Gamba, dated Sep. 28, 2016. 26 pages.

* cited by examiner

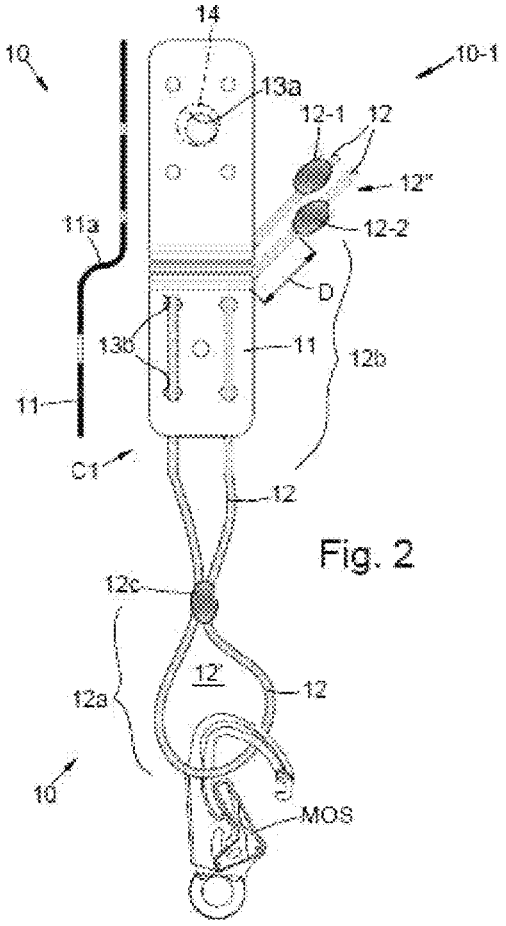

Fig. 2

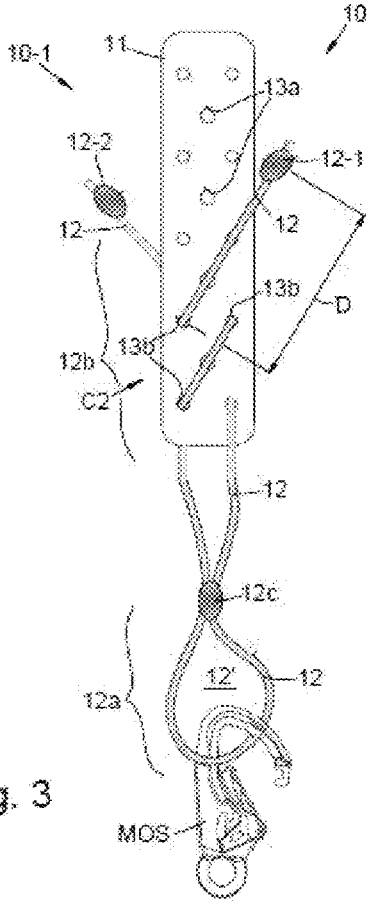

Fig. 3

PROVIDING A ROPE SAFETY DEVICE (10, 10-1) OF THE TYPE INCLUDING A PLATE (11) WITH A PLURALITY OF HOLES (13) AND A ROPE (12) INSERTED INTO AND SUITABLE TO SLIDE IN THE HOLES (13b) OF THE PLATE (11)

↓

FIXING THE PLATE (11) WITH HOLES ON THE BEARING STRUCTURE (TR) OF A ROOF (T) OR A COVERING

↓

ADJUSTING THE ROPE (12) WITH RESPECT TO THE PLATE (11) IN WHICH HOLES (13b) THE ROPE IS INSERTED SO AS TO LEAVE THE ROPE (12) FREE TO SLIDE, BEFORE BEING BLOCKED, ALONG A CERTAIN STROKE (D) IN THE HOLES (13b) OF THE PLATE (11), WHEN THE ROPE (12) IS ACCIDENTALY SUBJECT TO A DRAUGHT (FT) FROM A USER ATTACHED TO THE SAME ROPE (12)

Fig. 6

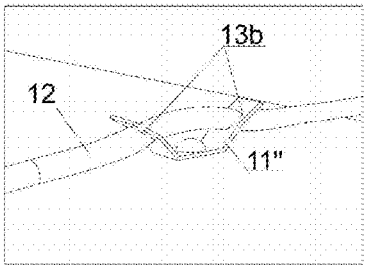
Fig. 9I
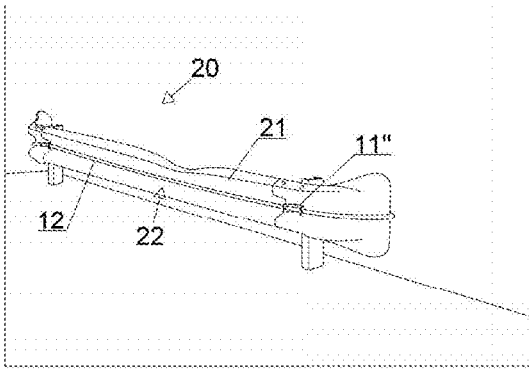
Fig. 9J
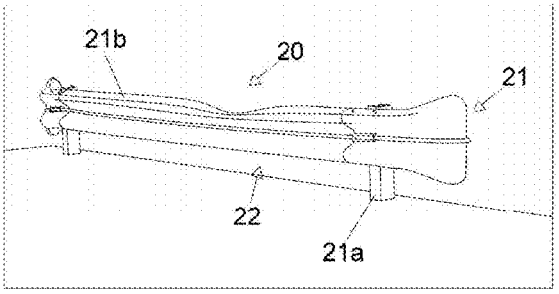
Fig. 9K
Fig. 9L
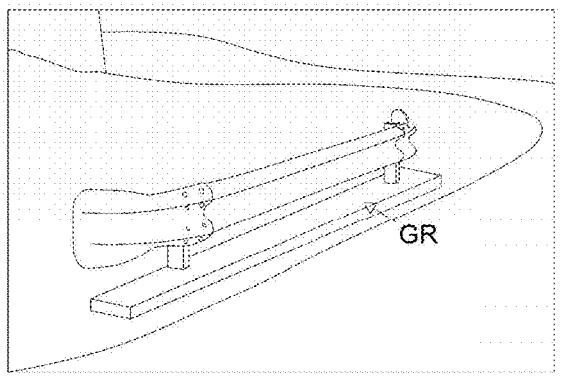
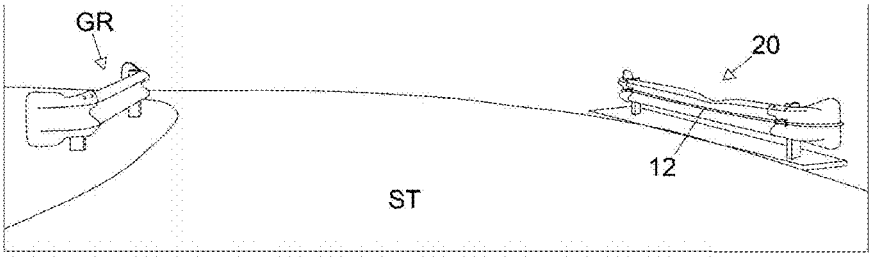
Fig. 9M

SLIDING ROPE SAFETY DEVICE FOR ROOFS AND THE LIKE, CORRESPONDING METHOD FOR DAMPING THE STRESSES ACTING ON A USER OF A ROPE SAFETY DEVICE AND GUARD RAIL WITH A SLIDING ROPE

CROSS REFERENCE TO RELATED APPLICATIONS

The present application is the U.S. national stage of International Patent Application PCT/IT2015/000150 filed on Jun. 8, 2015 which, in turn, claims priority to Italian Application B12014A000005 filed on Jun. 10, 2014.

FIELD OF THE INVENTION

The present invention relates in general to the field of systems and safety devices for roofs and/or covers, i.e. of those systems, equipment and devices which are typically designed to be installed on roofs and/or similar structures in order to make them safe in respect of the persons and operators that operate on such structures, as also to the field of systems and devices for road security and protection, installed along the edges of a road, to contain a vehicle, when skipping or having a sideslip, inside the road.

More specifically, the invention relates to a safety device of the type comprising a cable or rope adapted to provide a safety attachment for those who work on a roof or a similar covering, wherein this safety device is suitable to be advantageously fixed under the tiles or a similar element of the roof or of the covering, so as to constitute an under-tile or sub-roof element, or to be associated with a rope safety line already installed on the roof or the covering, and wherein, in both applications, the safety device presents the significant advantage of effectively dampening and cushioning the impact suffered by the operator in the event that, while he is attached to the rope for safety reasons, puts accidentally in traction and pulls the rope of the safety device.

The present invention also relates to a corresponding method for avoiding that an operator or a user in general is subject to dangerous impacts and stresses, when, being attached to a rope safety device installed on a roof or similar structure, activates accidentally the safety device and thereby pulls the respective rope, for example because of a slippage of the operator on the roof on which he operates and is walking, whereby the safety device intervenes to retain him.

Finally the invention also relates to a new and innovative road safety barrier, or guard rail, installed along the edges of a road, comprising a sliding rope suitable to absorb the stress and the impact energy caused by the collision of a vehicle against the same barrier.

BACKGROUND OF THE INVENTION AND STATE OF THE PRIOR ART

There are currently known various systems, devices and tools that are provided for being installed on a roof or in general a coverage in order to make it safe in respect of an operator or in general of a person who is operating and walks on the same roof or coverage.

In particular these known devices and tools, once installed on a roof or coverage, are adapted to offer useful grips and safe attachment points to which the person can attach himself, so as to put him in a safe condition and therefore never run the risk of falling from the roof or from the coverage, for instance in case of unexpected events or slipping while working and walking on the roof or the coverage.

Some of these known safety systems and devices include the use of a rope or a cable which is fixed at one end, for example by means of a bracket, to the fixed structure of the roof or cover to make safe, and which presents at the opposite end an eyelet in which a user, operating on the roof or on the cover, can insert for example a spring-clip in order to hook to the rope the anti-fall harness of the same user.

In this way the user is placed in a safety condition, since he always remains firmly anchored and held, via the rope or cable of the security device, to the roof or to the cover on which he operates and walks, whereby he never runs the risk of falling from the roof or from the cover and then getting hurt, even in case of possible unexpected events or slipping while walking on the roof or on the cover.

However these rope safety devices, known, exhibit, despite their widespread use, some drawbacks and limitations that are not negligible.

In particular, among these drawbacks, there is mentioned the fact that these rope o cable safety devices appear to be rather stiff, i.e. unable to satisfactorily mitigate the impact and the stresses to which the respective user is subject when, for instance in case of an unexpected event or a slipping on the roof on which he is operating, the user causes the intervention of the safety device, and thereby pulls and puts accidentally in traction the rope of such a device to which he is attached in order to operate in safe condition.

In fact, in these circumstances, the impact suffered by the user can be considerable and also potentially dangerous for his health.

Another disadvantage is apparent from the fact that these safety devices and tools, known, of the type including a rope or also of another type, exhibit at least in general a rather complex construction and also they often require a work that is not simple and therefore expensive in order to be stably installed under the tiles of a roof or the single elements of a cover.

Moreover, still in connection with safety field, the known technique, in addition to systems and safety devices, such as those illustrated before, installed on a roof or a covering, offers various types and embodiments of road metal barriers or guard rails, provided for being installed along the edges of a road, for security purposes, in order to contain a vehicle, in case of skidding, within the road and/or the carriageway.

Furthermore, in addition to the typical guard rails of metal, the prior art includes a wide range of types of guards and/or protective barriers installed along a road for security purposes.

Of course in this context it is always felt the need to further improve, with respect to what is already known and in use, both the guard rails and in general all the various types of protective and safety barriers that can be installed along a road to make it safe, and in particular to improve the capacity of these guard rails and protective barriers of effectively absorbing the energy and the stresses produced by the impact against them of a vehicle when skidding or swerving along the road.

DISCLOSURE OF THE INVENTION

Therefore a primary object that the present invention aims to achieve is to propose and provide a new and advantageous safety device, of the type including a rope, for use on roofs or similar coverings, involving significant improvements in comparison to the devices actually known and in use, and in particular having the capacity of significantly dampening the impact and the stresses to which a user, operating on the roof or on the covering, is subject, when he causes the intervention of the safety device to which he is attached and therefore puts in traction the respective rope.

Another object, still connected to the previous one, of the present invention is also to provide a rope safety device which exhibits a simple construction, consisting of a limited number of parts so as to be suitable to be easily installed under the tiles of a roof or the single elements of a cover.

A further object of the present invention is also to provide a rope safety device, adapted to make sure roofs or similar coverings, which, in addition to be suitable to effectively dampen the impact and the stress acting on the respective user when accidentally putting in traction the rope of the device is also suitable to be integrated and associated with a wider rope safety system for the roof or the covering.

Still a further object of the present invention is to provide a rope safety device that can be usefully and advantageously applied and used also as a device for individual protection. i.e. in the field of so-called PPE (Personal Protective Equipments), so as to provide security in a wide range of activities, such as mountain climbing and more.

Finally, a last object of the present invention is also to propose a new guard rail or a new road safety barrier that innovates significantly compared to the guard rail and in general to the protective and safety barriers currently in use and installed along the edges of a road, and in particular is able to absorb effectively the energy due to the impact against it of a vehicle when skidding, in order to contain the same vehicle, even after the impact, within the road and/or the roadway.

The above objects are achieved by the rope device safety, as well as by the method to give greater security and in particular to avoid that an operator, attached to a rope safety device installed on a roof or similar structure, is subject to dangerous impacts and stresses when accidentally puts into traction and pulls the rope of the same safety device, and finally by the safety barrier or guard rail, installed along the edges of a road, having the characteristics defined by the respective independent claims.

Particular embodiments of the invention are also defined by the dependent claims.

Advantages of the Rope Safety Device of the Invention

The sliding rope safety device of the invention offers numerous advantages, in part already before announced, among which there are cited purely by way of indication the following:

- an effective damping of the impact and stress suffered by the operator, attached to the rope of the safety device, when accidentally puts in traction the respective rope, for example following a fall or a sliding or another similar unexpected event that involves the operator while working on the roof on which the device is installed;
- possibility of adjusting the damping effect applied to the operator in the event of an accidental pull of the rope of the device;
- a reduced size, and a quick and easy installation of the device even by non-specialized personnel;
- possibility of applying the device as a sub-tile element so as to allow a perfect integration of the device with the tiles or covering elements of a roof;
- easy adaptability of the safety device to the roof or to the covering on which it has to be installed, in particular thanks to a mounting plate, part of the same device, easily deformable;
- possibility of associating the device with rope security lines pre-existing and already installed on roofs and coverings;
- a reduced cost of manufacture and installation of the device.

BRIEF DESCRIPTION OF DRAWINGS

These and other objects, features and advantages of the present invention will clearly appear from the following description of some preferred embodiments and applications thereof, made solely by way of a non-limiting example, with reference to the accompanying drawings, in which.

FIG. 2 is a view of the sliding rope safety device of FIGS. 1A-1C, according to the present invention, with the respective fixing and damping plate in a suitably bent configuration for application of the safety device as an under-tile or under-roof element;

FIG. 3 is a view of the sliding rope safety device of FIGS. 1A-1C, according to the present invention, in a configuration in which the rope is inserted in the fixing and damping plate in a crosswise way;

FIG. 6 is a flow chart illustrating a method, according to the invention, directed to give greater security and in particular to avoid that an operator, attached to a rope in order to operate in a safe condition on a roof or similar structure, be subject to dangerous impacts and stresses, whereas he accidentally puts in traction the rope to which he is attached;

FIGS. 9I-9M are photographs showing a prototype of the new guard rail of the invention of FIGS. 9A-9H, and comparing it with a conventional guard rail;

Figure 1A:
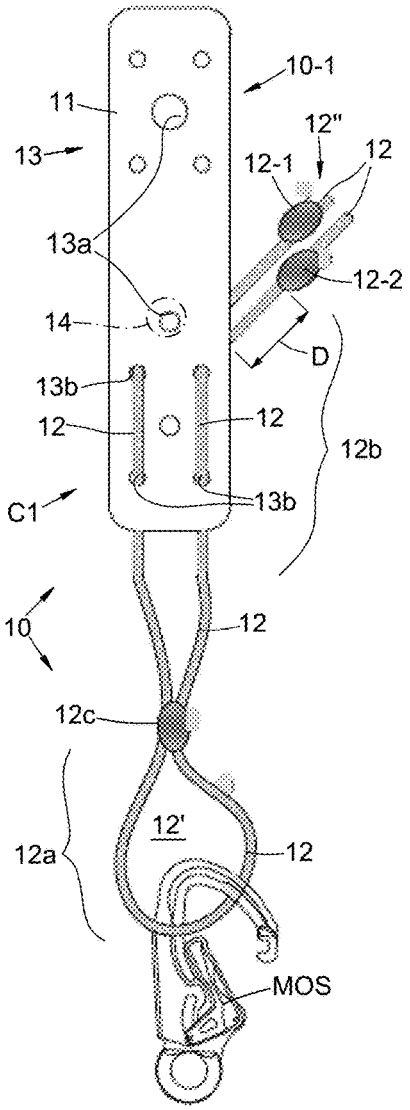
FIG. 1A is a view of a sliding rope safety device, for roofs and coverings, according to the present invention, with damping capacity so as to operate as energy absorber, in a first embodiment, suitable for the application of the safety device as a sub-tile element, comprising a fixing and damping plate in a flat and non bent configuration.

DESCRIPTION OF SOME PREFERRED EMBODIMENTS AND APPLICATIONS OF THE ROPE SAFETY DEVICE OF THE INVENTION FOR ROOFS AND COVERINGS

With reference to the drawings, a sliding rope safety device for roofs and coverings, according to the present invention, is indicated as a whole by 10.

Within the general technical concept which is at the origin and the basis of the present invention, the safety device 10 can be realized according to a wide variety of configurations and embodiments, and be applied and used in a corresponding wide variety of circumstances and applications.

So, in order to allow a complete understanding of the invention, in its various and multiple aspects, in the following there will be described, in detail, some preferred of these configurations, embodiments and possible applications of the rope safety device 10.

It is also pointed out that, in the following description, the reference to a given embodiment and application does not exclude that a particular configuration, structure or feature described in relation to this particular embodiment and application can also be included in other embodiments and applications in which for reasons of synthesis it has not been described.

It also follows that particular configurations, structures and/or features of the invention may be combined in any appropriate and consistent way in one or more embodiments and applications.

It is also specified that the references used here only respond to needs of convenience and therefore they do not define in any way the scope of protection and scope of the embodiments and application hereinafter described.

Application of the Rope Safety Device as an Under-Tile Element Anchored to the Structure of a Roof or a Cover FIGS. 1A-1D show a first embodiment, denoted by 10-1, of the sliding rope safety device 10 of the invention, wherein the safety device is typically provided for being installed and fixed in a stable manner, so as to constitute an under-roof or under-tile element, on a bearing structure of a roof or in general of a covering.

In particular, in this first embodiment, the sliding rope safety device 10-1 comprises:

- a bracket or a fixing and damping plate 11, perforated, also called fastening and damping plate, adapted to be installed and fixed on the bearing or supporting structure of a roof or a covering, generally indicated with T, to make safe by means of the device 10-1, wherein the roof T in turn comprises a plurality of tiles or similar elements, each indicated with TEG, arranged on and supported by the supporting structure; and
- a rope or cable 12 associated with the bracket or the fixing and damping plate 11.

The plate 11 in turn has a plurality of through-holes, indicated as a whole with 13, of which a part of the holes, indicated with 13*a*, are used to fix the same plate 11 to the roof, the cover or similar structure T, on which the safety device 10 is installed, and another part of the holes, indicated with 13*b*, are used to insert the rope 12, as clearly shown in FIG. 1A and described below in more detail.

Figure 1B:
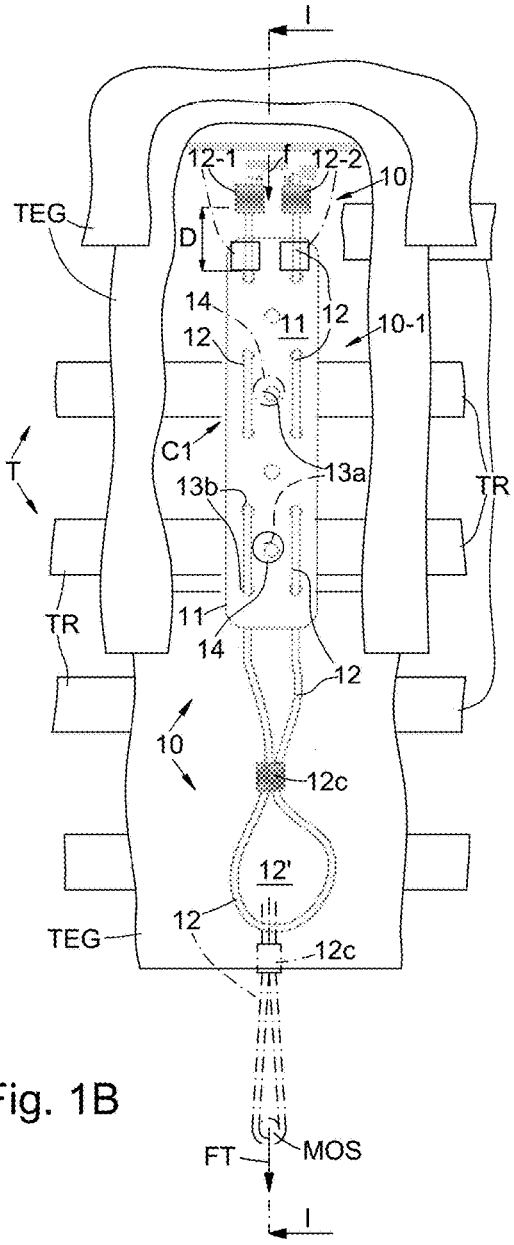
FIG. 1B is a schematic plan view of the safety device rope of FIG. 1A in a typical application as a sub-tile element in a roof or a cover.
Figure 1C:
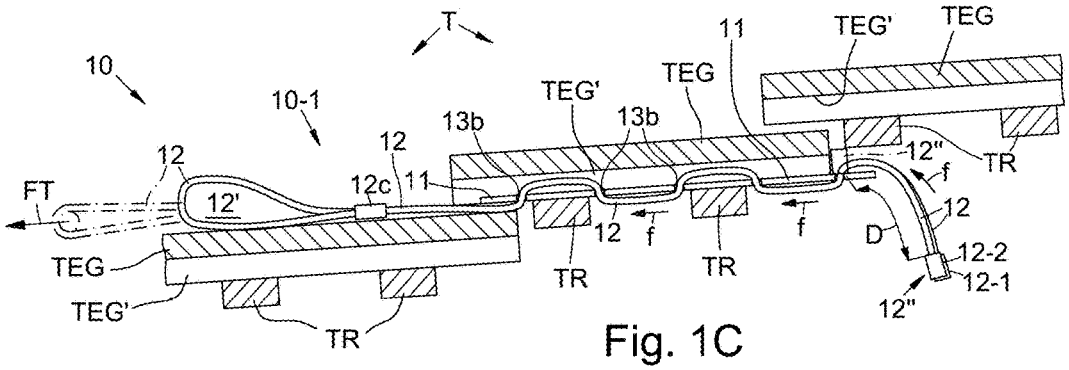
FIG. 1C is a schematic sectional view along the line I-I of FIG. 1B showing the sub-tile anchoring of the sliding rope safety device.

FIGS. 1B and 1C shows that the sliding rope safety device 10 of the invention, once installed on the supporting structure of the roof T, can be for instance housed in a suitable space or recess, denoted by TEG', formed and defined by the tile TEG arranged above the safety device 10 in the roof T.

For clarity. FIG. 1A shows the safety device 10-1 alone, separate from the roof T on which is provided for being installed, while FIGS. 1B and 1C show in plan and laterally the device 10-1, once it has been mounted and firmly fixed on the roof T, in particular on the respective supporting structure, for example formed by crossbars TR, using the through holes 13*a* formed in the plate 11.

Figure 1D:
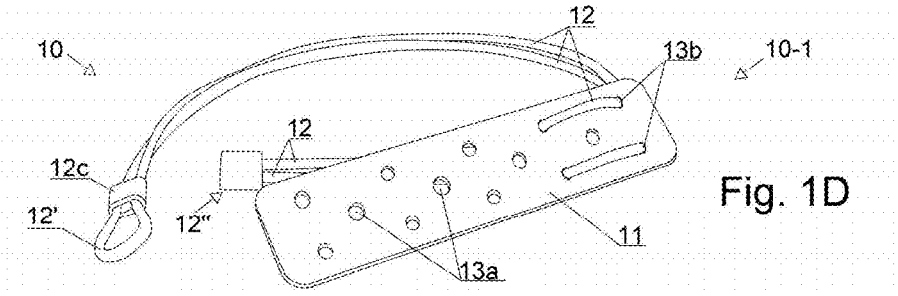
FIG. 1D is a view in perspective form of the sliding rope safety device of FIG. 1A.
Figure 1F:
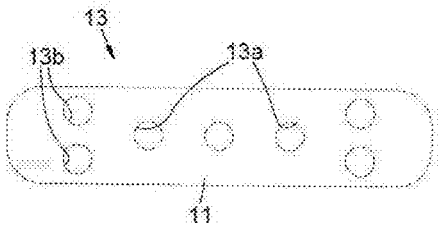
FIGS. 1F and 1G show in detail some embodiments of the fixing and damping plate of the safety device of FIGS. 1A-1C of the invention, and its relevant dimensions.
Figure 1E:
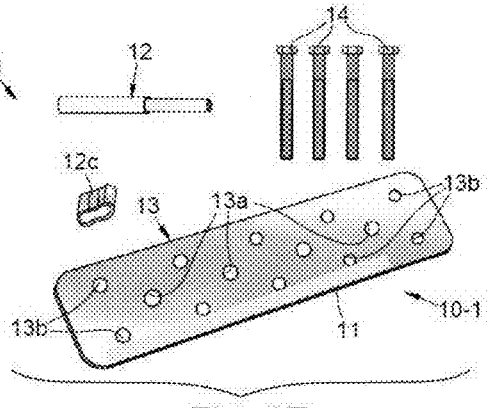
FIG. 1E is a schematic view showing, in disassembled form, the various parts making up the sliding rope safety device of FIG. 1A.
Figure 1G:
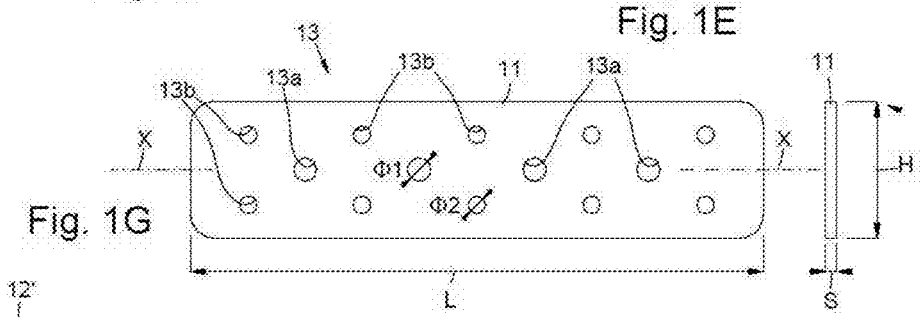

Again, for clarity, FIG. 1D shows in perspective form the rope safety device 10-1, in assembled form, while FIG. 1E shows the same device 10-1 in a disassembled and exploded form, i.e. broken down into the various pieces of which it is composed FIGS. 1F and 1G show in turn some embodiments of the fixing and damping plate 11 of the device 10-1 with some possible configurations of the respective through holes 13*a*, for fixing the plate 11 to the supporting structure of the roof T TR, and of the respective through holes 13*b*, for the insertion of the rope 12 in the same plate 11.

As an indication, with reference to FIGS. 1F and 1G, the relevant dimensions of the plate 11 can assume the values included in the following fields:

- length L: 150 to 400 mm.
- height H: 30 to 80 mm;
- thickness S: 2÷3 mm;
- diameter Φ1 of the holes 13*a* for fixing the plate 11 to the roof: 8÷16 mm;
- diameter Φ2 of the holes 13*b* for inserting the rope 12 in the plate 11: 6÷12 mm.

Figure 1H:
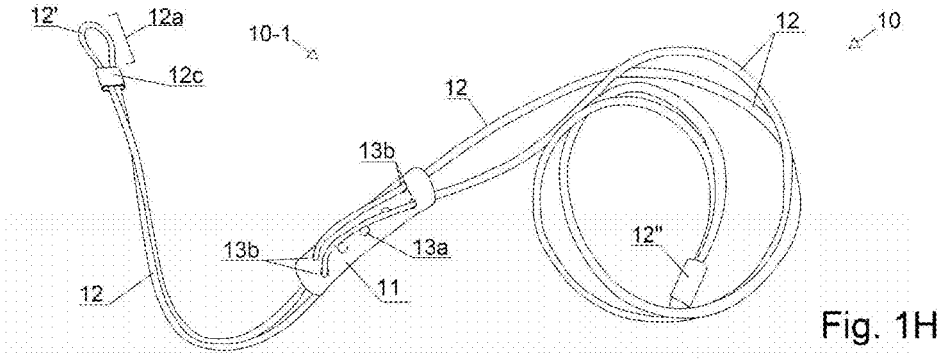
FIG. 1H is a photographic image of a specimen of the sliding rope safety device of the invention of FIGS. 1A-1C.

Finally the photographic image of FIG. 1H shows a physical specimen of the safety device 10-1, separated from the roof on which it is provided for being installed.

For example the device 10-1 can be installed on the roof T by means of a plurality of bolts 14, shown in FIG. 1E, which are inserted in the holes 13*a* of the plate 11 and screwed into the bearing structure TR of the roof T, so as to fix stably to the latter the plate 11.

The fixing and damping plate 11 of the safety device 10-1 is preferably made of a metallic material, for example stainless steel, and has a thickness S such that it can be easily deformed and bent so as to adapt its shape and configuration to that of the bearing structure TR of the roof or cover T on which the safety device 10-1 is installed.

For clarity, FIG. 2 shows the rope safety device 10-1 with the respective fixing and damping plate 11 exhibiting such a folded or bent configuration, in turn defined by a fold 11*a*, suitable to adapt the plate 11 to the roof structure T on which the device 10-1 is installed.

The rope 12 in turn is configured so as to exhibit, when it is inserted in the holes 13*b* of the fixing and damping plate 11, as shown in FIGS. 1A-1C, an attachment and coupling portion, indicated by 12*a*, which forms an eyelet or loop 12', adapted to allow an operator or in general a user to attach himself on to the same rope 12, and then to operate in a safety condition on the roof, the cover, or the structure T on which the device safety rope 10-1 is installed.

In particular, the eyelet 12' is formed in the rope 12 by means of a clamp 12*c* which is clamped on a central portion, bent into a U, of the rope 12.

For example, as shown in FIG. 1A, the user can attach himself to the rope 12 by inserting into the eyelet 12' a spring-clip MOS connected to the equipment or anti-fall harness worn by the same user.

In an advantageous even if not exclusive embodiment, the sliding rope or cable 12, essential part of the safety device 10 of the invention, may be of the type conforming to the special composite rope including a central core of steel wires and at least a layer formed around the central core of steel and consisting of braided threads of Kevlar, i.e. of aramid fibers, which is described in the international patent application PCT No. PCT/IT2012/000306, in the name of the same applicant, published as WO 2013/051 043 A2, incorporated herein as regards to the part concerning such a rope or cable 12.

However it is clear that the rope 12 can be realized in various ways and types, that have always to be considered inside the invention, and for example it may not be of the layer or multi-layer type, and be only constituted by a braid of filaments and/or metal strands.

According to an essential feature of the present invention, the fixing plate and damping plate 11 and the rope 12, in turn inserted in the holes 13*b* of the plate 11 of the rope safety device 10-1, are configured and adapted to cooperate by friction between them, in the effective use of the same security device 10-1 with the plate 11 and thus also the safety device 10-1 stably fixed to the structure TR of the roof T, in such a way that the rope 12, when it is subject accidentally to a given draught or traction stress in the area of the respective attachment and engagement portion 12*a* by an operator attached to the same rope 12, for example as effect of a sliding or a fall of the operator, reacts by sliding in a controlled manner into the holes 13*b* of the plate 11 in which the rope 12 is inserted, before being retained by the plate 11 fixed to the roof or cover T.

In this way, in the effective use, the safety device 10-1 is adapted to dampen and absorb the impact and stresses acting on the operator when, while it is attached to the rope 12 of the device 10-1 to operate in safety conditions on the roof T, the cover or the similar structure on which the safety device 10-1 is installed, accidentally puts into traction and pulls the rope 12 of the same device 10-1.

In other words, the fixing and damping plate 11 and the rope 12 by cooperating between them, with the rope 12 that slides into the holes 13*b* of the plate 11 in which it is inserted, are adapted to act and operate as dissipating and absorbing elements of the energy produced by the pull or draught of the rope 12, so as to effectively dampen the impact to which the operator is subject in those circumstances in which he accidentally, e.g. because of a sliding or a fall or another similar unexpected event while he is working on the roof, puts into traction the rope to which the operator is attached.

Therefore, as clearly shown in FIGS. 1A-1C, the rope 12, once it is inserted in the fixing and damping plate 11, in turn fixed to the roof T, exhibits a configuration comprising a sliding portion, generally indicated with 12*b*, which is adapted to slide, in the event of a pull of the rope 12, through the holes 13*b* formed in the plate 11.

Furthermore, in order to retain the same rope 12 at the end of the sliding in the holes 13*b* determined by the shot or pull to which it is subjected, the two ends of the rope 12 are each associated with a respective lug or terminal 12-1, 12-2, for example cylindrical, also denoted as a whole with 12", with each lug having an outer diameter greater than the diameter of the holes 13*b* in which the rope 12 is inserted.

Therefore, these lugs or terminals 12-1 and 12-2 are adapted to limit the sliding of the rope 12 in the holes 13*b* of the plate 11 and to lock or block the rope 12, as hereinafter more fully described.

The rope 12 may be associated with and be inserted, according to various modes and configurations in the fixing plate and damping 11, so as to be able to slide along a given stroke D, when it is accidentally subjected to a tensile stress by an operator attached to the same rope 12, before being retained and held by the plate 11.

The fixing and damping plate 11 in turn, as already stated, can be realized with different configurations of through holes 13*b* in which the rope 12 is inserted.

For example, as shown in FIGS. 1A and 1B and in FIG. 2 the plate 11 may present a series of through holes 13*b* arranged in a row, along the longitudinal extension, defined by an axis X, of the same plate 11, wherein the rope 12 is inserted in these rows of holes 13*b* according to a linear and non-crossed configuration, indicated with C1.

Or, as shown in FIG. 3, the plate 11 may still present a series of through holes 13*b* arranged in a row, but with the rope 12 inserted into these rows of holes so as to exhibit a cross configuration indicated by C2.

In the effective application and use, as shown in the flow chart of FIG. 6, the safety device 10-1 is installed on the roof T to make sure by stably fixing the fixing and damping plate 11 of the device 10-1 on the bearing structure TR of the roof T, in particular by using the through holes 13*a* formed in the plate 11.

Then the rope 12, already inserted in the holes 11*b* of the plate 11, is appropriately adjusted and disposed relative to the latter, so as to be able to slide, when the rope 12 is pulled and subjected to traction, in the holes 11*b*, before being retained by the same plate 11.

For example, as shown in FIG. 1A, the rope 12 is regulated by suitably spacing, according to a determined distance or stroke D, the two terminals 12-1 and 12-2, provided at the ends of the rope 12, in the corresponding holes 13*b* adjacent to such terminals 12-1 and 12-2, so as to exhibit a sliding portion 12*b* adapted to slide in the holes 13*b*, exactly according to this determined distance D, before being retained by the same plate 11.

Figure 4A:
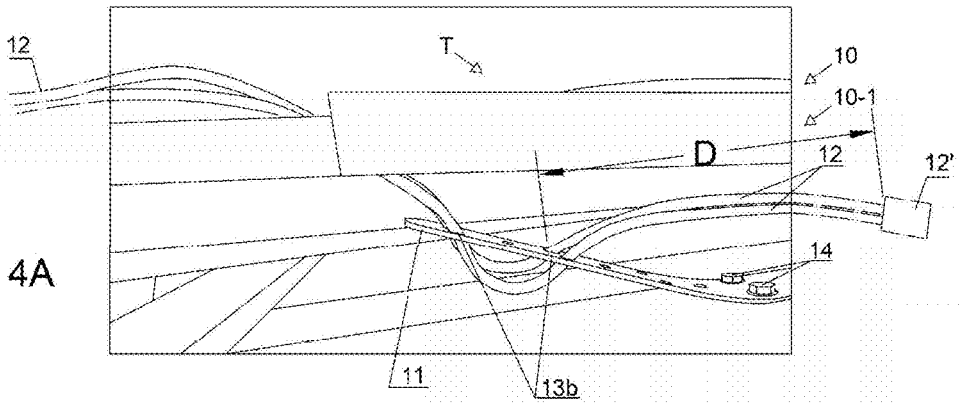
FIGS. 4A-4C are photographs which show the effective application of the sliding rope safety device with damping capacity, according to the present invention, as an under-tile element.
Figure 4B:
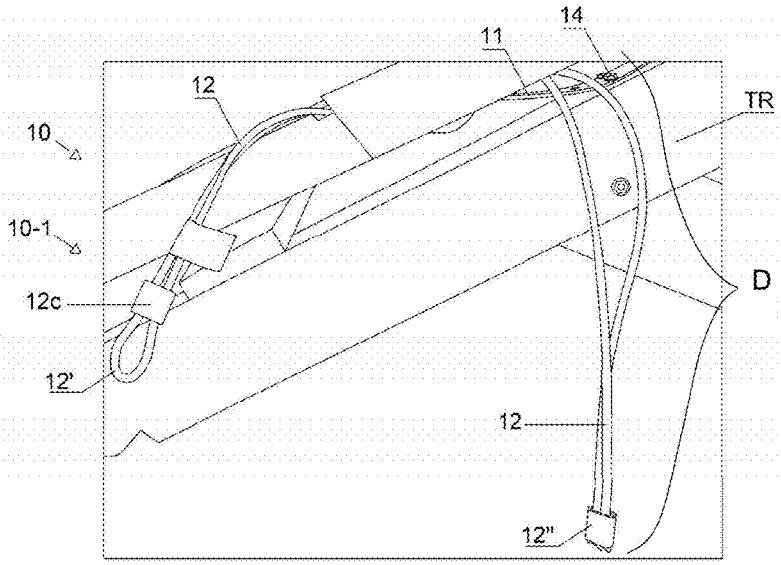
Figure 4C:
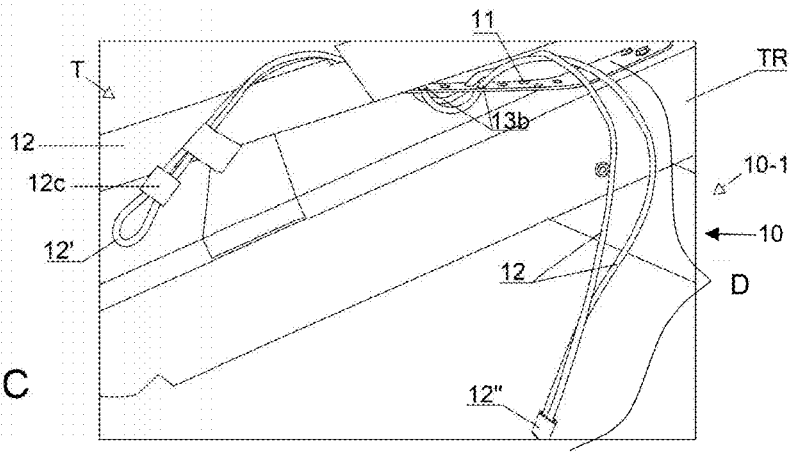

For clarity, the photographic images of FIGS. 4A-4C show a specimen of the safety device rope 10 of the invention, once it has been fixed on the bearing structure of a roof T, so as to constitute an under-tile element, and the rope 12 has been suitably adjusted, with the respective terminals 12" spaced from the holes 13*b* of the plate 11, so as to be able to slide in the same plate 11 according to a given stroke D.

So an operator, and in general a user, when he has to operate on the roof T on which the device 10-1 is installed, has the opportunity to engage and attach himself, for example via a spring-clip, to the rope 12, and in particular to the respective eyelet 12', so as to act in conditions of safety, while working on the roof T.

Now it may happen that the operator, while working on the roof T, applies a shot or a traction force FT, schematically indicated by an arrow in FIGS. 1B and 1C, to the rope 12 to which he is attached, for example because the operator accidentally slips or falls on the roof.

Therefore, in this circumstance, the rope 12 of the safety device 10-1 reacts to the sudden draught and traction FT to which it is subjected by sliding through a certain distance, as indicated by arrows f in FIGS. 1B and 1C, in particular according to the determined distance D previously set during adjustment of the rope 12, in the holes 11*b* of the plate 11, before being retained and locked, as shown with dash and dot line in FIGS. 1B and 1C, by means of the rope terminals 12-1 and 12-2, provided at the ends of the same rope 12, which abut and stop against the plate 11, thus obtaining the effect of significantly absorbing and dampening the impact and the stresses to which the device is subjected in the aforesaid such circumstance.

It is therefore clear from the above description that, in this embodiment 10-1 of the safety device 10 of the invention, the fixing and damping plate 11, in association with the sliding rope 12, corresponds and carries out the specific damping means which perform the function of damping and absorbing the impact energy and the stress acting on the operator when, while he is attached to the rope 12 of the device 10-1 in order to operate in safety conditions on the roof T, accidentally puts into traction the same rope 12.

Figure 5A:
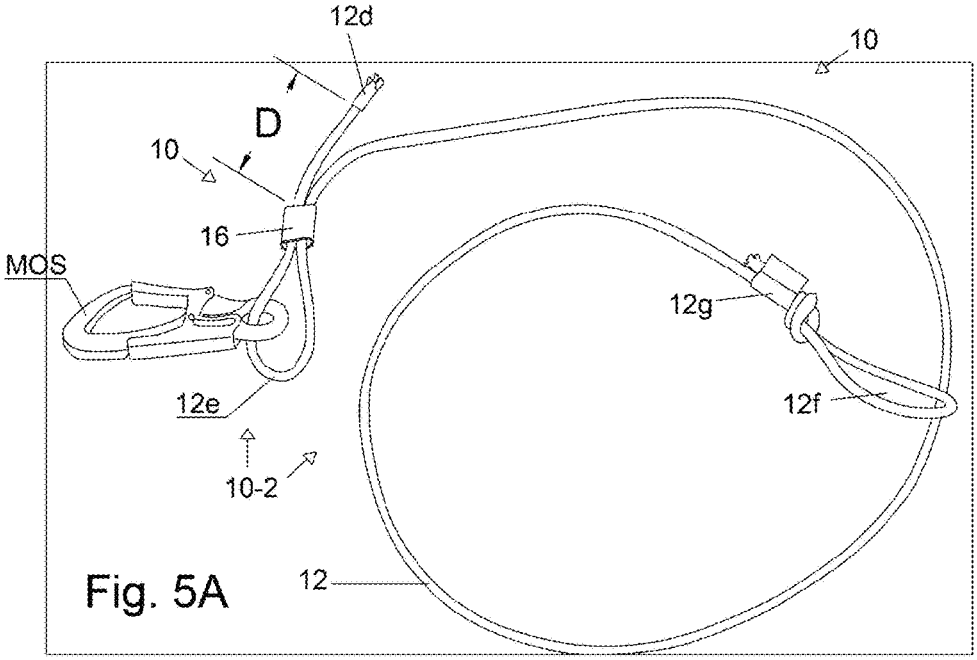
FIG. 5A is a photographic image of a sliding rope safety device, for roofs and coverings, according to the present invention, with damping capacity so as to operate as energy absorber, in a second embodiment, suitable for the application of the safety device in combination with a rope type safety line, wherein the safety device comprises in this second embodiment, instead of a fixing and damping plate, as in the first embodiment of FIG. 1A, a calibrated clamp.
Figure 5B:
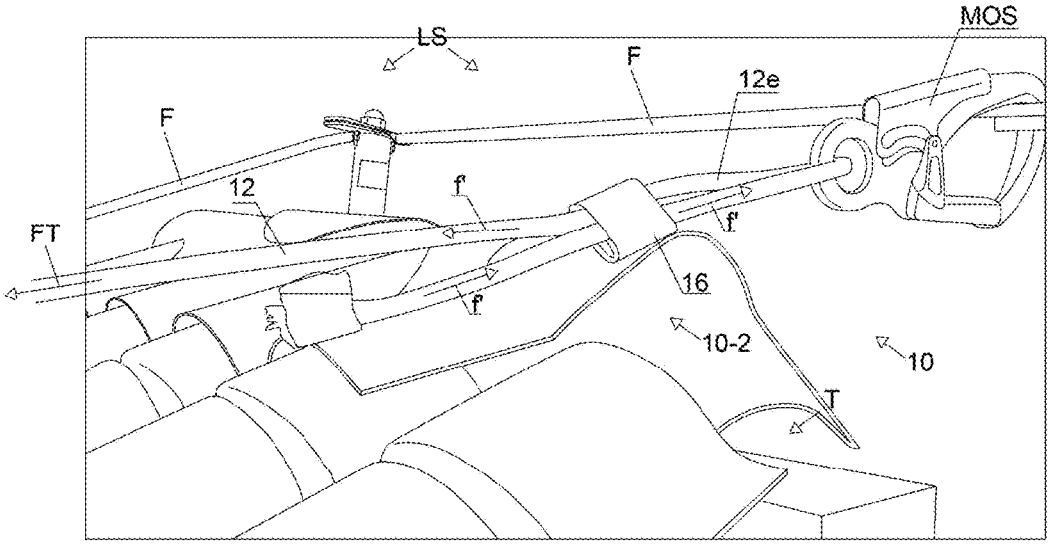
FIG. 5B is an image photographic which show the effective application of the sliding rope safety device of the invention, in the second embodiment of FIG. 5A, in combination with a rope safety line installed on a roof.
Figure 7A:
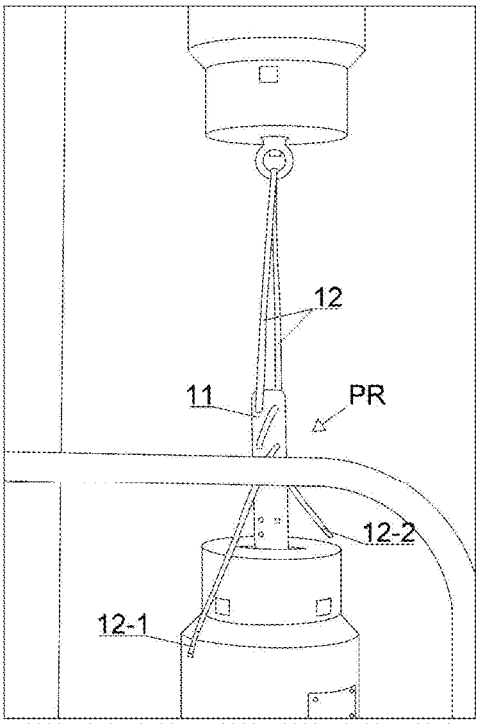
FIGS. 7A-7E are further photographic images related to trials and tests that were carried out, in specialized laboratories, on samples and specimens of the sliding rope safety device of the invention, in order to verify its performance and innovative features.
Figure 7B:
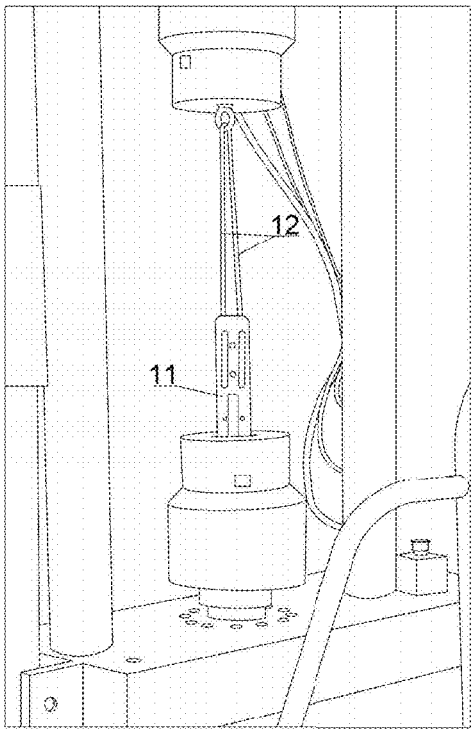
Figure 7C:
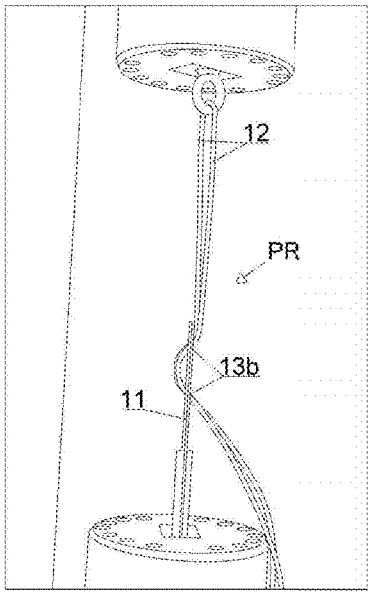
Figure 7D:
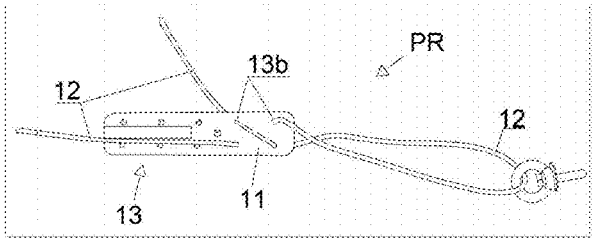
Figure 7E:
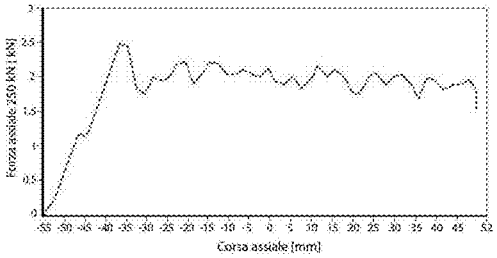

Application of the Device Rope Safety in Combination with a Safety Line Rope Installed on a Roof or a Cover The photographic images of FIGS. 5A and 5B show a second embodiment, indicated with 10-2, the sliding rope safety device 10 of the invention, wherein this safety device 10-2 is adapted to be advantageously applied in combination with a rope safety line, also called lifeline system, indicated generally with LS, already installed on a roof or in general a cover T.

In particular, in this second embodiment, the sliding rope safety device 10-2, for roofs and coverings, comprises, in place of a fastening and damping plate as in the first embodiment 10-1 of FIG. 1A, a clamp, suitably calibrated, indicated with 16, which is fixed to an end portion of the rope 12 so as to form an eyelet 12*e*, in turn usable to engage, for example via a spring-clip MOS, the safety device 10-2 to a rope F of the safety line LS installed on the roof T.

This clamp 16 is clamped on the rope 12 of the safety device 10-2, in order to form the eyelet 12*e*, with a predetermined clamping force which is calibrated in order to allow for a controlled sliding of the rope in the same clamp 16 when the operator, while being attached via the device 10-2 to the safety line LS installed on the roof T or cover or similar structure on which he operates, applies to the same rope 12 a certain shooting or pulling force, as described in detail in the following.

A lug or terminal 12*d* is fixed to the end of the portion of the rope 12 which forms the eyelet 12*e* in order to limit the sliding of the rope 12 in the calibrated clamp 16.

The rope 12 of the device 10-2 is also configured, as shown in FIG. 5A, so as to exhibit a further eyelet 12*f* at the end opposite to that of the eyelet 12*e*, wherein this eyelet 12*f* is formed by a further clamp 12*g*. not calibrated. and has the function of allowing the engagement and attachment of an operator, for example via a spring-clip MOS, to the same rope 12.

In the use of the safety device 10-2, the operator, who wants to operate in safety conditions on the roof T equipped with the safety line LS, engages the eyelet 12*e*, formed at one end of the rope 12 by the calibrated clamp 16, with the rope F of the safety line LS through a spring-clip MOS, and also attach himself, through another spring-clip MOS, to the eyelet 12*f* formed at the opposite end of the rope 12.

When the operator, by operating on the roof T, accidentally puts in tension the rope 12 of the safety device 10-2, or apply on the latter a certain tensile force FT, the rope 12 reacts promptly by sliding in a controlled manner in the calibrated clamp 16, as indicated by arrows f' in FIG. 5B, so as to cushion and dampen the impact and the stresses incurred by the operator in such circumstances.

In addition, similarly to the first embodiment 10-1 previously described and as shown with a dash-dot line in FIG. 5B, also in the safety device 10-2 of this second embodiment the rope terminal 12*d*, which is arranged adjacently to the calibrated clamp 16, intervenes and stops against the latter whereas the rope 12 is subject to the maximum sliding defined by a distance D.

In this way it is avoided that the rope 12 come and slip out of the calibrated terminal 16.

Therefore it is clear that, in this second embodiment 10-2 of the safety device of the invention, the damping means that are associated with the respective sliding rope 12 in order to absorb the impact energy and the stresses acting on the operator when, while being attached to such a rope to operate in safety conditions on the roof, the cover or a similar structure on which the safety device is installed, accidentally puts into traction and pulls the same rope 12, are constituted instead than by a fixing and damping plate, perforated, suitable to be fixed on the supporting structure or frame of a roof or similar coverage, so as to allow the application of the device as an under-roof element, as in the first embodiment 10-1, by the clamp 16, calibrated, which clamps an end portion of the rope 12 of the rope safety device 10-2 so as to form an eyelet 12*e* to allow the hooking of the same device 10-2 to the cable or rope F of the rope safety line LS that is installed on the roof or similar coverage.

It follows that also in this second embodiment 10-2 the rope safety device of the invention exhibits damping capacity so as to operate as energy absorber when the rope 12 is accidentally subjected to a traction by the operator who is attached to it.

It is also clear that the rope device safety rope of the invention, corresponding to this second embodiment 10-2, can be applied, other than to secure a user to a rope safety line installed on a roof or a similar coverage, also, in general, to secure and anchor the user to an anchorage point or system installed in any manner, thereby not only on a roof or similar coverage Experimental Tests Performed on Specimens of the Safety Device of the Invention The safety device with a sliding rope of the present invention has been the subject of numerous and intensive experimental tests in specialized laboratories in order to confirm its innovative features and to verify its effective performances.

In this regard, the photographic images of FIGS. 8A-8E show the sophisticated mechanical and electronic instrumentation that has been used for the execution of these tests, and some of the specimens PR that have been tested.

It is emphasized that the tests have fully confirmed the expectations, and in particular the capability of the sliding rope safety device of the invention to effectively absorb the tensile stresses acting on it, as well as the capability of the same device to be suitably adjusted and calibrated so as to cushion and absorb the tensile stresses in a variable range from 200 kg up to 600 kg.

Figure 8B:
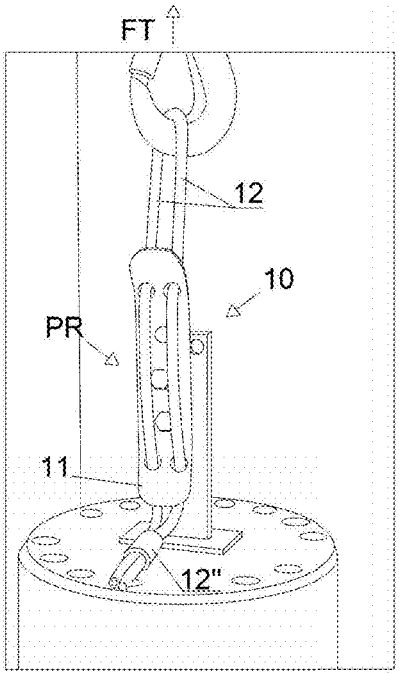
FIGS. 8A-8E are further schemes and photographic images concerning a specific experimental test performed on a specimen of the sliding rope safety device of the invention having a fixing and damping plate exhibiting a folded shape.
Figure 8A:
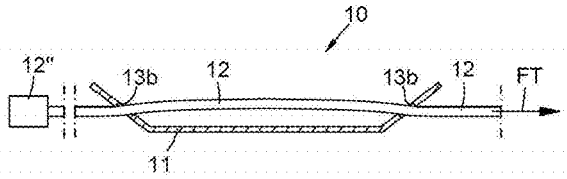

For reference, the photographic images of FIGS. 8B-8E show a specific experimental test carried out on a specimen PR of the sliding rope safety device 10 of the invention, wherein this specimen PR has a bracket or fixing and dumping plate 11 which exhibits a folded configuration, as shown schematically in FIG. 8A.

In particular, the photographic image of FIG. 8B shows the specimen PR of the rope safety device 10 of the invention during the execution of the test, in which the rope 12 of the device 10 is subject to a tensile force FT as to cause the sliding of the same rope 12 in the holes 13*b* of the plate 11.

Figure 8C:
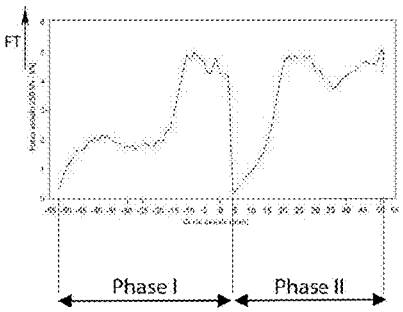

The photographic image of FIG. 8C shows in turn a diagram, displayed on the measurement equipment used in the test, which shows the trend of the tensile force FT which is applied to the rope 12, while sliding in the holes of the plate 11, during the execution of the test.

As can be seen from this diagram, the rope 12, because of the tensile or traction force FT applied to it, slides into the holes 13*b* of the plate 11, in a first phase I during the execution of the test, until the terminal 12" provided at one end of the rope 12 comes into contact and abuts against the plate 11, whereby the rope 12 is stopped and finishes its sliding stroke.

Figure 8D:
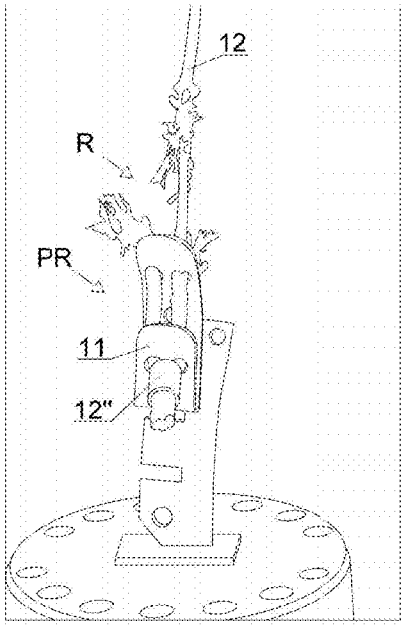

Then, in a subsequent phase II of the test, the tensile force FT, which continues to be applied to the rope 12, causes the curling of the plate 11, as shown in FIG. 8D.

Figure 8E:
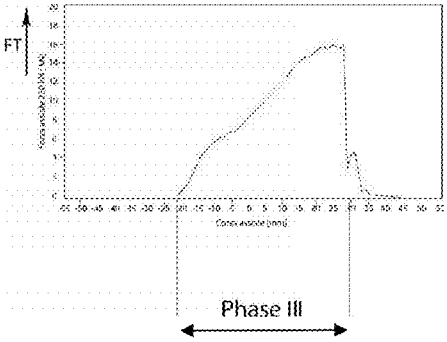

Finally, in a final step III of execution of the test, represented by the diagram of FIG. 8E, after the plate 11 of the safety device 10 is completely curled, the break of the rope 12 occurs, as denoted by R and again shown in FIG. 8D.

Advantageously, as already stated, the rope slide included in the safety device of the invention may be of the special type, with an inner core of steel wires, and at least one outer layer formed of braided threads of Kevlar, i.e. aramid fibers, corresponding to the special cable or rope described in the PCT patent application No PCT/IT2012/000306, in the name of the same applicant, published as WO 2013/051043 A2.

However, it is pointed out that the rope included in the safety device of the present invention is not limited to the embodiment described in the above PCT patent application, but can be realized in various other ways and configurations, and for example it can be simply constituted by a braid of filaments and/or metal strands.

Furthermore the rope safety line LS, in combination with which the security device 10 of the invention can be used, is for example that described in the same PCT patent application No. PCT/IT2012/000306, above cited.

It is therefore clear, from what described and from the experimentation carried out, that the present invention fully achieves the previously set objects and goals, and in particular proposes a safety device, for installation on roofs and coverings in general, of the type comprising a rope to which an operator can attach himself in order to operate in safe conditions on the roof or the covering, wherein this safety device is adapted to allow a controlled sliding of the rope such as to efficiently absorb and to dampen the impact and stress suffered by the same operator whereas he accidentally puts in traction the rope to which is attached, for instance because of a slipping or falling on the roof on which he is working.

Furthermore, the safety device of the invention may advantageously constitute an under-roof element adapted to be installed under the tiles of a roof, or it can be associated and applied in combination with a rope safety line, pre-existing and already installed on a roof or a cover.

Again, the safety device of the invention in its embodiment illustrated in FIG. 5A, can be advantageously used, in order to dampen the impact and stress suffered by a user when accidentally puts in traction the rope of the same device, as well as in combination with a rope safety line or a life line installed on a roof or covering, even as a simple personal protective equipment or tool, i.e. in the field of so-called PPE (Personal Protective Equipment), for example in the field of mountaineering and mountain activities, as well as in general in the field of other activities where there is the need to work safely.

Without prejudice to the basic concepts of the present invention, it is also evident that the device safety rope installed on a roof or similar coverage to make it safe and the corresponding method to avoid that an operator, attached to a safety device rope installed on a roof or similar structure, be subjected to dangerous impacts and stresses if accidentally puts in traction and pulls the rope of the device, may be widely varied and subject to modifications and improvements with respect to what has been described and illustrated up to here, without departing from the scope of the same invention.

Application of the Sliding Rope Safety Device on Road Safety Barriers, Guard Rails and Similar Protections It is clear that the inventive concept underlying the present invention, including the controlled sliding of a safety rope, subject to traction, in order to absorb and dissipate an impact energy by friction, is not limited to a use and to an application on roofs and coverings, in particular in order to avoid that an operator, attached for security to the rope and operating on these roofs and coverings, is subject to dangerous impacts and stresses when he accidentally pulls the same rope, but it can be usefully and advantageously applied in a wider range of circumstances and operative situations and for various purposes, as for example to carry out road safety barriers or crash barriers, or similar protections, improved and more efficacious than those currently known and in use.

Therefore in the following there will be described some embodiments in which, in line with the concept underlying the invention, a sliding rope, adapted to have a controlled sliding in order to dampen and absorb an impact energy, is associated with a road safety barrier or a crash barrier or a similar protection.

Metal Barrier Containment or Guard Rail

With reference to FIGS. 9A-9E, a metal containment barrier, or guard rail, according to the present invention and indicated as a whole with 20, comprises a metallic structure, generally indicated with 21, substantially identical to that of a conventional guard rail currently in use and installed along the edges of a road ST for making it safe and in particular containing a vehicle, even in case of skidding, within the road ST, wherein this metal structure 21 is constituted by a plurality of metal uprights 21*a*, vertical, which are firmly planted in the ground along the edge of the road, and by an upper longitudinal member or containment rail 21*b*, shaped, horizontal, which is fixed to these uprights 21*a* and constitutes the part provided to receive, by deforming if necessary, the bump and hit of the skidding and swerving vehicle and to contain it, even after the collision, inside the road ST.

According to an essential feature of the present invention, the guard rail 20 comprises and integrates a sliding rope device, indicated as a whole by 22, adapted to substantially increase the capacity of the guard rail 20 to absorb the impact energy and the stresses caused by a vehicle which skids and hits the guard rail, and therefore also suitable to increase the capacity of the same guard rail 20 to contain the vehicle, even after the collision, inside the roadway.

In detail, this safety device 22 to the rope sliding, which, as said, uses and applies the same inventive concept of the sliding rope safety device 10 and of the respective embodiments 10-1 and 10-2, as before described, installable on a roof or similar coverage, includes a rope 12 which is associated with suitable damping means having the function of damping and absorbing, via a controlled sliding of the same rope 12, the impact energy and the stresses acting on the guard rail 20, when a vehicle skids and hits against it.

In particular, these damping means, structurally and operatively analogous to those already described in relation to the sliding rope device 10 before described for roofs and coverings and therefore indicated with the same reference numeral 11. are constituted by one or more fixing and damping plates, which are fixed to the metal structure 21 of the guard rail 20, wherein these one or more fixing and damping plates 11 are adapted to cooperate by friction with the rope 12 so as to allow a controlled sliding of it with respect to the same plates 11, when the rope 12 is subject to a traction force as a consequence of the impact and hit that is suffered by the guard rail 20 when the vehicle swerves and collides with it.

Both the fixing and damping plates 11 and the rope 12 associated with these plates 11 can be realized according to a multiplicity of configurations and embodiments and be arranged in various ways with respect to the metal structure 21 of the guard rail 20.

Figure 9A:
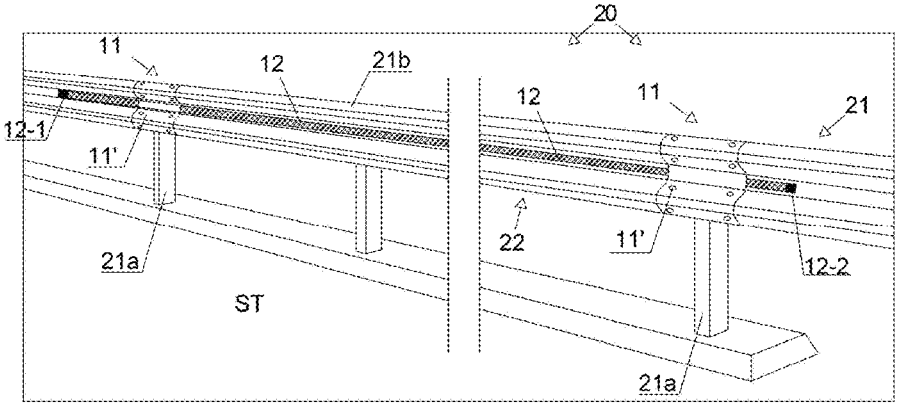
FIGS. 9A-9H are graphic views that relate to a road safety barrier, or guard rail, according to the present invention, installed along the edges of a road and including a sliding rope able to absorb and dissipate the energy produced by the impact of a vehicle against the guard rail.
Figure 9B:
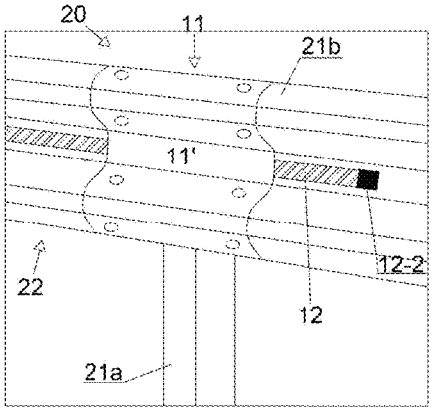

For example, in a first embodiment shown in FIGS. 9A and 9B, the fixing and damping plate 11 can be constituted by a plate, indicated with 11', which exhibits in cross-section a shape which corresponds to that of the upper rail 21*b* of the supporting structure 21 of the guard rail 20, and is fixed to said rail 21*b* with the interposition of the rope 12, so as to press and tighten the rope 12 against the rail 21*b* with a given clamping force, calibrated.

The rope 12, pressed against the rail 21*b* by the shaped plates 11' can in turn exhibit at the opposite ends two respective terminal 12-1 and 12-2, and be initially mounted and adapted, in the guard rail 20, with these end terminals 12-1, 12-2 arranged at a certain distance from the plates 11' which press the same rope 12 against the upper rail 21*b* of the guard rail 20.

Therefore, in the effective use of the guard rail 20, that is when a skidding vehicle impacts and collides with the upper rail 21*b* of the same guard rail 20, the rope 12, in consequence of this collision, is subject to a tensile force which determines a controlled sliding for a certain distance with respect to the plates 11' and to the rail 21*b*, up to when the rope 12 is retained by the respective terminals 12-1 and 12-2 which abut against the shaped plates 11' fixed to the upper rail 21*b* of the guard rail 20.

Figure 9C:
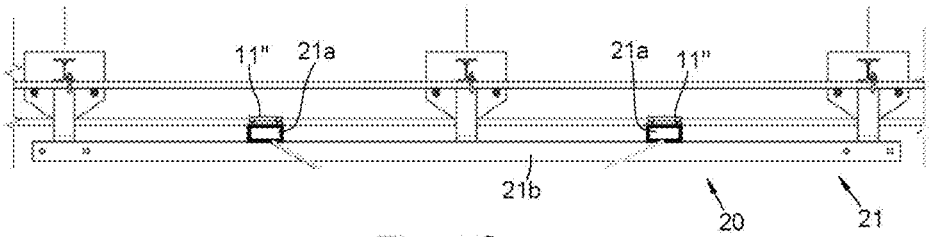
Figure 9D:
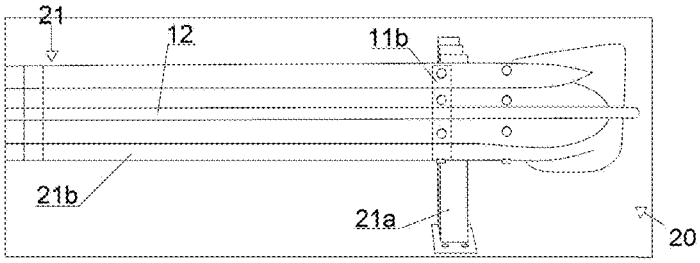
Figure 9E:
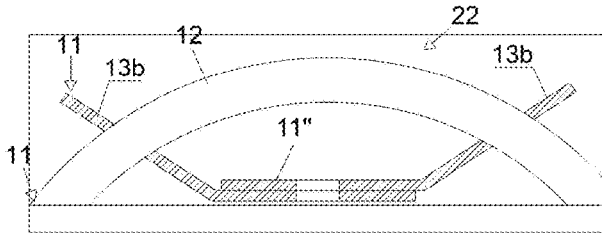
Figure 9F:
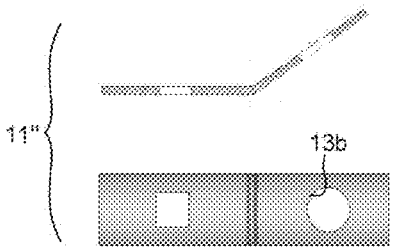

Or, in a further embodiment as schematically shown in FIGS. 9C and 9E, the fixing and damping plate 11 can be constituted by a plate 11" perforated, fixed to the upper rail 21*b* of the guard rail 20, wherein this plate 11" has a configuration including one or more holes 13*b*, or a similar configuration, which are used to insert the rope 12 in the same plate 11.

Even in the case of this second embodiment 11" of the fixing and damping plate, the rope 12, inserted in the holes 13*b* of the plates 11", exhibits at the two opposite ends two terminals, and is initially mounted and adapted, in the guard rail 20, with these end terminals arranged at a certain distance from the corresponding perforated plates 11" fixed to the upper rail 21*b* of the guard rail 20.

The plate 11", fixed to the upper rail 21*b* and the holes 13*b* in which it is inserted the rope 12, can take various configurations and for example be formed by two pieces, as shown in FIG. 9E.

Moreover, these perforated plates 11" may be fixed to the rail 21*b* of the metal structure 21 of the guard rail 20 both along its front surface, facing towards the road, and also along its rear surface, i.e. on the back of the rail 21*b*, as shown schematically in FIG. 9C.

Therefore, in the actual use of the guard rail 20, that is when a vehicle skids and collides with the upper rail 21*b* of the guardrail 20, the rope 12, in consequence of this collision, is subject to an impulsive force of traction that causes the rope 12 to slide in a controlled manner and along a certain stroke in the holes 13*b* of the plates 11", before being retained by the respective terminals 12-1 and 12-2 which abut against the perforated plates 11" fixed to the upper rail 21*b* of the guard rail 20.

Thus, in both embodiments, described above, including the fixing and damping plate 11' or 11', the sliding rope device 22, essential and characterizing part of the guard rail 20 of the invention, activates, in case of skidding of a vehicle and its consequent collision against the guard rail 20, a controlled sliding of the rope 12 which has the effect of dampening, absorbing and dissipating efficaciously, in cooperation with the metal structure 21 or the structure of a conventional guard rail, the impact energy and the stresses caused by the skidding vehicle which hits the guard rail 20.

As said, in the guard rail 20 of the invention, the rope 12 associated with the fixing and dumping plates 11 fixed to the upper rail 21*b* of the guard rail 20 can assume various configurations.

For example, in addition to the configuration, shown in FIGS. 9A and 9B, in which the rope 12, exhibiting at its opposite ends the two rope terminals 12-1 and 12-2, extends only on the front, i.e. along the front side, facing the road, of the metal rail 21*b*, the rope 12 can be arranged in a configuration in which it extends and is positioned also or only on the back, i.e. along the rear side of the metal rail 21*b*, as shown schematically in FIGS. 9C and 9D.

The sliding rope device 22, included in the new guard rail 20, may comprise a single rope 12, or also two or more ropes 12, which extend and are arranged one above the other along the rail 21*b* of the guard rail 20, and are also associated with corresponding fixing and damping plates 11, consistently with the embodiments before described.

Figure 9G:
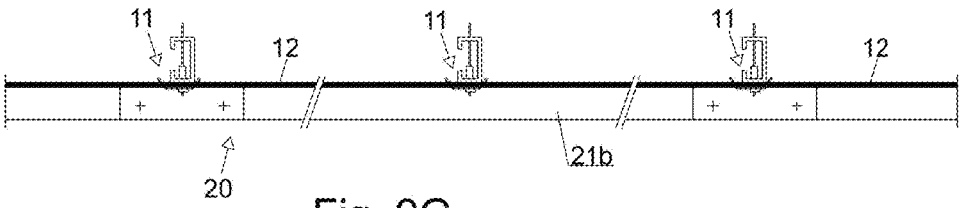

To complete the picture of the possible variants of the guard rail 20. FIG. 9G shows a further respective embodiment in which the sliding rope 12 extends along the back of the rail 21*b*.

Figure 9H:
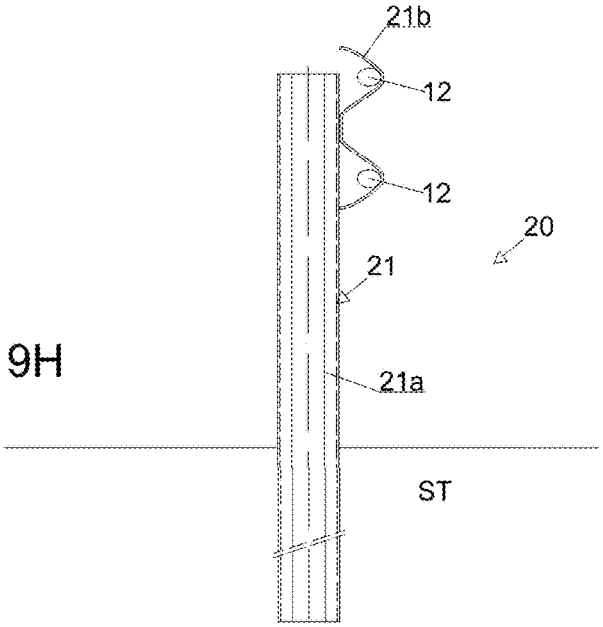

FIG. 9H in turn shows in section the shaped rail 21*b*, of the metal structure 21 included in the guard rail 20, wherein the rail 21*b* houses along its back side, not facing the road ST, two ropes 12 for damping the impact caused by the impact of a vehicle against the same guide rail Still, for greater clarity, the photographic images of FIGS. 9G-9K show a prototype of the new guard rail 20 of the invention alone and in comparison with a guard rail of the conventional type, indicated with GR.

From what described above there are clear the advantages, in part already announced, of the invention both in the form of the new guard rail 20 and in the form of a kit or sliding rope device adapted to be advantageously mounted on a conventional guard rail, already installed along the edges of a road, in order to improve its performance, such as in particular:

- increase in the resistance of the guard rail to the impact force determined by the impact of a vehicle that swerves;
- reduction of the stresses suffered by the driver of the vehicle which swerves and hits the guard rail;
- possibility to update quickly and at a relatively low cost, with the device or kit rope sliding, existing guard rail, so as to increase significantly the strength and performance in order to contain the vehicle swerves inside of the road;
- greater security than that provided by the single metal structure and the upper rail of the guard rail, in order to control inside the road of a vehicle swerves and hits the guard rail.

Sliding Rope Road Safety Barrier

Figure 10A:
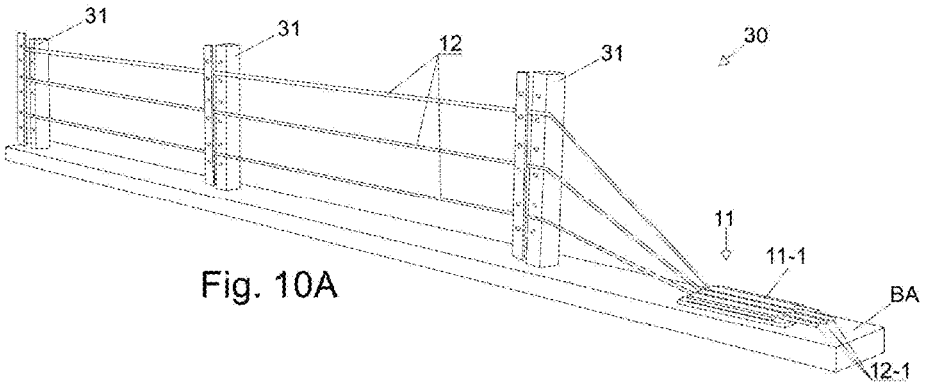
FIGS. 10A-10C are graphic diagrams showing a sliding rope safety barrier, according to the present invention, installed along the edges of a road.
Figure 10B:
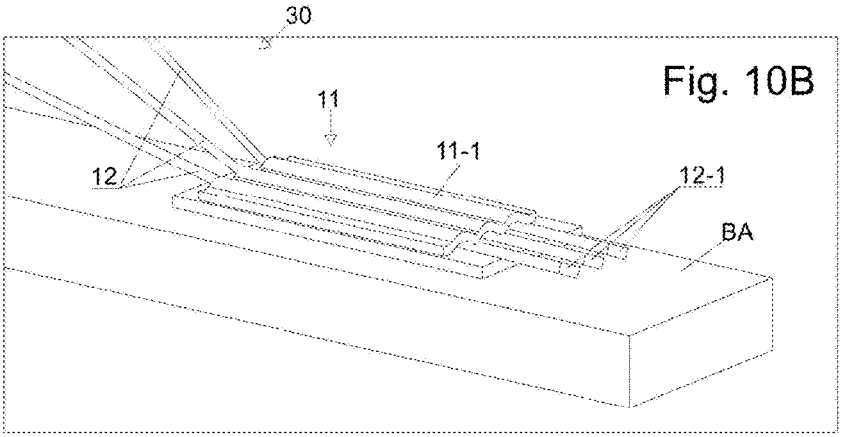
Figure 10C:
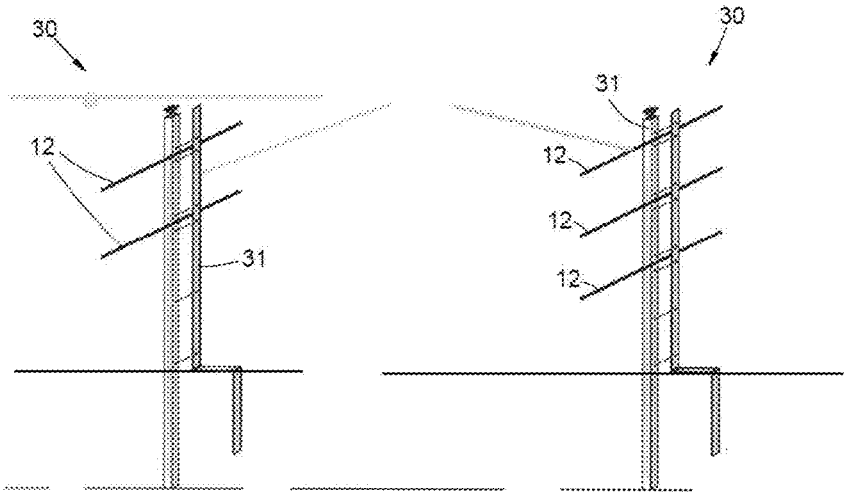

With reference to FIGS. 10A-10C, a safety barrier, according to the present invention and generally indicated at 30, typically installed along a road or in similar context, comprises a plurality of uprights 31, which are planted in the ground along the edge of road, and a plurality of ropes or cables 12 which extend horizontally and are supported by these uprights 31.

The rope 12, included in the barrier 30, can be single, or double or triple, as shown in FIGS. 10A and 10B.

Similarly to the embodiments described before, the rope or ropes 12, essential part of the barrier 30, are associated with damping means, indicated generally at 11, that are configured to cooperate in relation of friction with the ropes 12 thereby causing a controlled sliding of the same rope 12 with respect to these damping means 11, when a vehicle skids and hits the barrier 30, so as to absorb, dissipate and dampen the stress and the impact energy received from the barrier 30 because of the impact of the vehicle.

In particular, as shown in FIGS. 10A and 10B, these damping means 11 may assume the form of a damping plate 11-1, which clamps and presses with a given clamping and pressing force, calibrated, the end portion of each of the ropes 12 against a fixed base BA.

The ropes 12 are in turn provided with a terminal 12-1 to at least one of their ends and are also positioned, in an initial configuration in the barrier 30, with such end terminal 12-1 arranged at a certain distance from the plate 11-1.

Therefore, in the use of the barrier 30. i.e. when a vehicle skids and hits the barrier 30 and puts into traction the ropes 12, these slide in a controlled manner in the plate 11-1 of the damping means 11, until the terminal 12-1 of each of the ropes 12 recovers the initial distance separating the same terminal 12-1 from the plate 11-1 and thereby abuts and stops against the latter, as indicated by an arrow f in FIG. 10B, so as to absorb and dampen effectively the energy and the stresses induced by the impact of the vehicle.

Advantageously and preferably the sliding rope or cable 12, essential part of both the new guard rail 20 and the new road safety barrier 30 before described, is, similarly to the embodiments provided for being installed on roofs and coverings, of the type conforming to the composite cable or rope that is described in the PCT international patent application No. PCT/IT2012/000306, in the name of the same applicant, published as WO 2013/051043 A2, incorporated herein, as already stated, with regard to the part concerning such a rope or cable 12.

It is specified that this rope, described by the PCT international patent application No. PCT/IT2012/000306, has a special configuration characterized by a central core of steel wires; an intermediate layer formed directly around and in contact with the central core of steel and consisting of braided threads of Kevlar, i.e. of aramid fibers; and an outer layer formed directly around and in contact with the layer of Kevlar and consisting of polyester threads, with these layers being adapted to cooperate in sliding relationship to each other and with the central core of steel, when the rope is subject to traction, and wherein the rope can also comprise further additional external layers in addition to those listed above.

Therefore the rope 12, essential part of the new guard rail 20 of the invention, thanks to this special configuration of its layers as well as to the special materials constituting such layers, has the ability to effectively absorb, in cooperation with the upper rail 21*b* of the metal structure 21 of the guard rail 20, the stress and the impact energy that are induced by a vehicle which skids and collides with the new guard rail 20, in particular by sliding in a controlled manner with respect to the plates 11 fixed to the rail 21*b* and with the various layers of the rope 20 which slide relative to one another and with respect to the central core of steel wires.

The significant benefits and improvements offered by this new guard rail 20 of the invention, compared to the conventional guard rails already known and in use, were also confirmed by numerous and extensive tests performed in specialized laboratories on samples and prototypes of the guard rail 20 and the respective sliding rope device 22 which is integrated and is an essential part of the same guard rail 20.

Figure 11A:
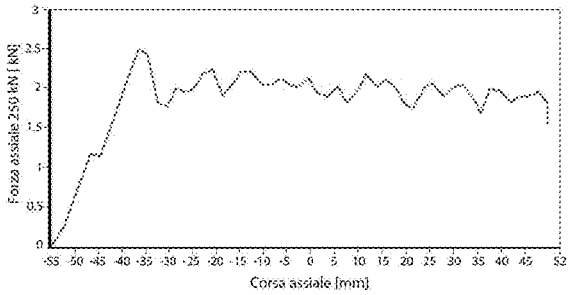
FIGS. 11A-11E are oscillograph traces and diagrams related to tests and trials that have been carried out on samples and prototypes of the guard rail of the invention and their respective parts.
Figure 11B:
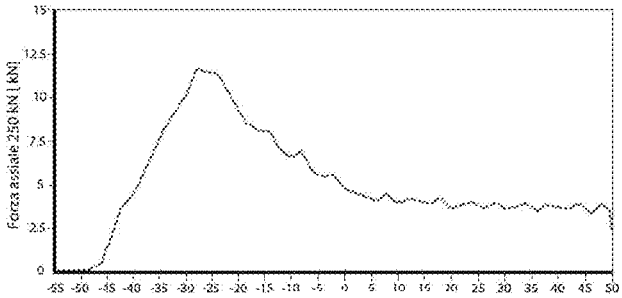
Figure 11C:
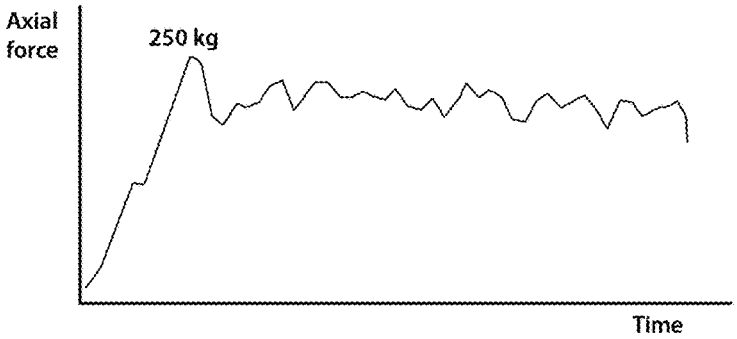
Figure 11D:
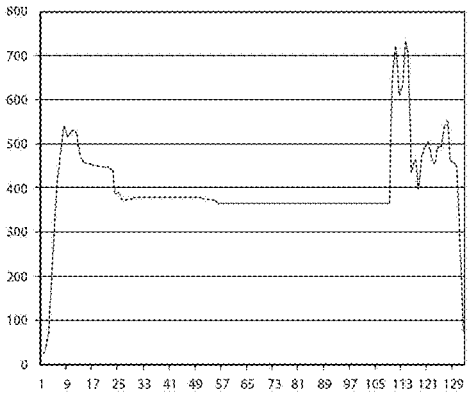
Figure 11E:
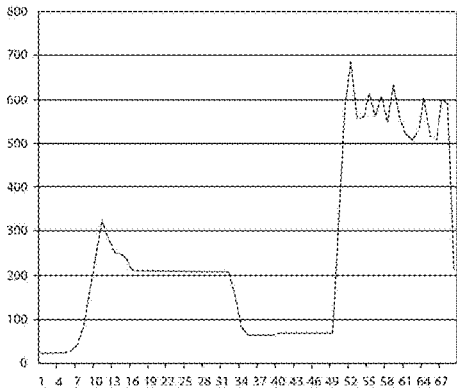

For completeness, FIGS. 11A-11C show the oscillograph traces concerning some tensile test, in a range between 2.5 and 12.5 KN, carried out on the sliding rope device 22 while the diagrams of FIGS. 11D and 11E summarize the results of sliding tests performed on a single dissipating plate of the device 22 integrated in the guard rail 20, wherein these results are expressed as a value in Kg of the axial force absorbed by the sliding rope device 22, depending on the number of samples tested.

However it is pointed out that the sliding rope 12, essential part of both the guard rail 20 and the road safety barrier 30 of the invention, can be realized in a variety of shapes and configurations and in particular it can be of the type comprising a core of metallic strands and one or more layers formed around said metallic core, or can be constituted solely by a rope, not covered, of metallic strands.

The invention claimed is:

1. A sliding rope safety device configured to be installed on a roof or a covering comprising a plurality of tiles for allowing an operator to operate in safety conditions on said roof or covering, including:

- at least one rope having an attachment and hooking portion, in the form of an eyelet, configured to allow the operator to be attached to the rope, and thereby to operate in said safety conditions on the roof or the covering on which the safety device is installed, and
- a fixing and damping plate configured to damp and absorb by friction, through a sliding of the rope in the fixing and damping plate, an impact energy and stresses acting on the operator when the operator is attached to the eyelet of the rope of the device in order to operate in said safety conditions on the roof or the covering and puts in traction and pulls the rope of the safety device installed on said roof or covering, wherein said fixing and damping plate is configured to be stably fixed on a supporting structure or a frame of the roof or the covering on which the safety device is installed, whereby the safety device is configured to be a sub-tile element of the roof or of the covering;

wherein said fixing and damping plate has a configuration exhibiting a plurality of through holes formed in the thickness of said plate, with a part of the through holes that is used for fixing said plate to the supporting structure or the frame of the roof or the covering, and with another part of the through holes that is used to insert the rope into the plate, whereby the rope extends in the through holes and along the two opposite sides of the plate, wherein said rope is configured and fitted to said plate to be suitable to cooperate with the fixing and damping plate, once fixed to the supporting structure or the frame of the roof or the covering, to allow the rope, when it is subject to a given pull or traction force in said attachment and hooking portion, to slide in the through holes of the fixing and damping plate in which the rope is inserted, wherein the rope is provided at its ends with one or more separate terminals or lugs, wherein the one or more separate terminals or lugs have each an outer dimension greater than that of adjacent holes in which the rope is inserted, and wherein, in an initial installation of the safety device on said roof or covering, said one or more terminals are entirely spaced according to a determined distance apart from the adjacent holes, of said fixing and damping plate, in which the rope is inserted, whereby, in use, when the operator is attached to the rope of the safety device in order to operate in safety conditions on the roof or the covering on which the safety device is installed and puts in traction and pulls the rope, in case of an unexpected event or incident the rope slides for a determined stroke by said determined distance, in the through holes of the plate prior to being retained by the terminals or lugs of the rope which stop and abut against the adjacent holes in which the rope is inserted, to damp and absorb by friction the impact energy and the stresses acting on the operator.

2. The sliding rope safety device according to claim 1, wherein said fixing and damping plate has an elongated shape and along a longitudinal direction, as defined by said elongated shape, the through of holes, and is also made of a material and sized with a thickness configured to be suitable to be bent and thereby the fixing and damping plate is shaped to be fixed to a part of the roof, or of the covering, and wherein the rope, inserted into the through holes of the fixing and damping plate, exhibits a parallel configuration, or a cross-inclined configuration with respect to the longitudinal direction of the same plate.

3. The sliding rope safety device according to claim 1, wherein said rope has a composite multi-layer configuration comprising:

a central core, in turn consisting of metal wires or strands, and at least one layer, made of braided yarns of aramid fibers or of other types of fibers, formed around the central core, or wherein the rope is made only of a metallic wire braid or metal strands.

* * * * *